United States Patent [19]

Danin

[11] 3,968,596

[45] July 13, 1976

[54] VEHICLE BARRIERS

[76] Inventor: Alex Danin, 1080 Mamaroneck Ave., White Plains, N.Y. 10605

[22] Filed: Sept. 19, 1974

[21] Appl. No.: 507,348

[52] U.S. Cl. ..... 49/49
[51] Int. Cl.[2] ..... E01F 13/00
[58] Field of Search ..... 49/35, 49, 131, 132, 49/197, 198, 203

[56] References Cited

UNITED STATES PATENTS

| | | | |
|---|---|---|---|
| 2,015,607 | 9/1935 | Shinn | 49/35 X |
| 2,874,819 | 2/1959 | Nutter | 49/35 X |
| 3,484,992 | 12/1969 | Blumenthal | 49/203 |
| 3,691,685 | 9/1972 | Danin | 49/49 X |

FOREIGN PATENTS OR APPLICATIONS

| | | | |
|---|---|---|---|
| 1,242,573 | 8/1971 | United Kingdom | 49/203 |

*Primary Examiner*—Philip C. Kannan
*Attorney, Agent, or Firm*—Steinberg and Blake

[57] ABSTRACT

A vehicle barrier of the type which will temporarily prevent an unauthorized vehicle from entering a given parking space or from passing through the entrance to any given area. An upright support is situated beside the path along which a vehicle will normally travel, and an elongated barrier arm has a blocking position extending laterally from the upright support across the path which otherwise would be travelled by the vehicle so as to prevent the latter from travelling along this path. A connecting structure connects the barrier arm to the upright support for swinging movement about a substantially horizontal axis between the blocking position extending across the above path and a substantially vertical non-blocking position extending along the upright support, with the horizontal axis around which the arm turns being situated at the region of a lower end thereof when the arm extends vertically in its non-blocking position, this arm swinging down from its non-blocking to its blocking position and up from its blocking to its non-blocking position while turning around the above axis.

11 Claims, 8 Drawing Figures

4
4
3
3
5
5
7
7
8
8
64
66
50
42
26
40
28
30
18
20
54
56
44
68
18
48
58
38
58
48
32
34
44
16
36
34
36
62
60
22
80
40
74
76
72
78
28
16
82
18
92
94
26
76
72
28
70
90
74
18
72
70
94
24
90
76
28
72
74
78
18

VEHICLE BARRIERS

BACKGROUND OF THE INVENTION

The present invention relates to barriers for preventing vehicles from travelling along predetermined paths.

Thus, as is well known, parking spaces for vehicles may be assigned to given individuals, so that only a vehicle of an authorized individual is intended to occupy a given parking space. In order to assure that the space is not occupied by an unauthorized vehicle, the rightful occupant will normally be able to place a barrier across the space when the authorized individual leaves the space in an unoccupied condition.

Thus, while arrangements of the above type are indeed well known, the conventional arrangements suffer from several drawbacks. For example, in order to economize a suitable upright with a pair of barrier arms suspended therefrom may conventionally be located at every other boundary line between a row of parking spaces, so that with this arrangement the barrier arms are swung up to blocking positions with a pair of barrier arms extending toward each other from a pair of successive uprights in order to block entrance to a pair of adjoining spaces situated between the pair of uprights. However, because of limitations in the possible height of the upright from which the barrier arms hang and because of limitations in the weight of the swingable barrier arm which is generally made of a heavy metal, such conventional barrier arms can only be made of a limited length. Therefore when they are in their blocking positions they extend only through a relatively small extent across a given parking space with the result that the free ends of a pair of barrier arms which project toward each other from a pair of successive uprights leave between themselves a space large enough for a vehicle to enter between the barrier arms which are in their blocking positions. In order to prevent movement of a vehicle into this space between such a pair of barrier arms, it is conventional to provide at the boundary lines which alternate with those where the uprights are located posts which thus become situated at every boundary line between a pair of successive uprights. With such posts in position of course a vehicle cannot then enter into the space between a pair of barrier arms which extend toward each other from a pair of successive uprights and which are in their blocking positions. However, such a conventional arrangement creates certain problems which are peculiar thereto. When the barrier arm is in a non-blocking position giving access to a given parking space, the vehicle must travel between an upright and the post at the adjoining boundary line, and for reasons of economy, the parking spaces are made only sufficiently wide to accommodate a conventional vehicle, so that a considerable amount of skill is required in order to drive a vehicle accurately into a parking space between an upright and a post. As a result of this arrangement, when a vehicle is not driven into a parking space with the required skill it becomes located to close to an upright or a post, causing a considerable amount of inconvenience by requiring people to squeeze through the narrow space between a post or upright and the vehicle, and indeed it is not uncommon for a vehicle to strike against a post or upright with such conventional arrangements.

Furthermore, because the barrier arms must of necessity extend through a given minimum distance to prevent access to a given parking space when the barrier arm is in its blocking position, it is essential to make an upright and an arm hanging therefrom of a given minimum length. The result is that even while making a barrier arm as short as possible nevertheless it weighs a substantial amount, requiring exertion of relatively powerful forces in order to raise the barrier arm to its blocking position, and indeed weak individuals such as women, children, or elderly people have encountered difficulty in swinging the barrier arm from its non-blocking to its blocking position.

Barriers of the above general type have created special problems at the entrance to a given area as the entrance to a large parking area where a barrier arm is situated in order to prevent unauthorized individuals from entering into the parking area. Such barrier arms are of necessity relatively large and considerable force is required to swing them between their blocking and nonblocking positions, bearing in mind that under these conditions the barrier arm must be repeatedly swung between its positions a large number of times since such barrier arms are situated at the entrance to the parking area. All of the cars which occupy the parking area will necessarily move through the entrance, and thus such barriers encounter a considerable amount of wear and use due to their repeated movement between blocking and non-blocking positions, and in addition it is difficult to move such arms because of the weight thereof.

SUMMARY OF THE INVENTION

It is thus a primary object of the present invention to provide a construction which will avoid the above drawbacks.

In particular it is an object of the present invention to provide a barrier assembly capable of having a barrier arm of any desired length while at the same time providing for the arm an upright support which can be relatively short.

Furthermore it is an object of the present invention to provide for a system of the above type barrier arms which can be made of sufficient length to prevent a car from entering into the space between a pair of successive barrier arms when they are in their blocking positions, so that in this way the use of additional posts for this purpose is not required.

Furthermore it is an object of the present invention to provide for an assembly of the above type barrier arms which while being considerably longer than was heretofore possible nevertheless can be easily swung between blocking and non-blocking positions without requiring exertion of relatively large forces so that any individual, even though not particularly strong, can easily swing the barrier arm of the invention between its blocking and non-blocking positions.

In particular, it is an object of the present invention to provide a barrier arm assembly of the above general type which can be very economically used not only for a row of parking spaces but also for an entrance to a given large area where, for example, a number of parking spaces are located.

In addition it is an object of the present invention to provide a construction of the above general type which is exceedingly economical and rugged while at the same time being very reliable in operation, lending itself to easy manufacture and setting up for use.

According to the invention the system for at least temporarily preventing the travel of at least one vehicle along at least one path includes an upright support means situated beside the latter path. An elongated barrier arm has a blocking position projecting laterally from this upright support means across the path for preventing a vehicle from travelling past the barrier arm along this path when the barrier arm is in its blocking position. A connecting means connects the barrier arm to the upright support means for swinging movement with respect thereto about a substantially horizontal axis between the blocking position extending across the path and a non-blocking position where the barrier arm extends substantially vertically along the upright support means to be situated with the latter beside the path to permit a vehicle to travel therealong. This connecting means connects the arm to the support means for swinging movement in an upward direction from the blocking to the non-blocking position and in a downward direction from the non-blocking to the blocking position, and the axis around which the arm swings is situated at a region of the lower end of the arm when the latter is in its non-blocking position.

BRIEF DESCRIPTION OF DRAWINGS

The invention is illustrated by way of example in the accompanying drawings which form part of this application and in which.

DESCRIPTION OF PREFERRED EMBODIMENTS

Figure 1:
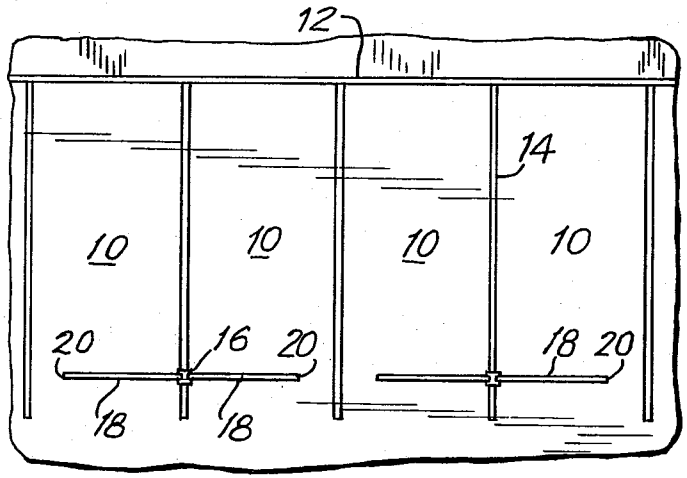
FIG. 1 is a schematic plan view of a system according to the present invention.

Referring first to FIG. 1, there is schematically represented therein a row of parking spaces 10 situated along a wall or curb 12. The parking spaces are separated one from the next by a plurality of boundary lines 14 which can be painted on the pavement or other surface on which the vehicles travel. The boundary lines 14 have a length of 18 feet, for example, and 16 feet from the wall or curb 12 is situated an upright support means 16. The several upright support means 16 are located at every other boundary line 14, as illustrated. Each upright support means 16 carries a pair of barrier arms 18 which can be moved between the blocking positions illustrated in FIG. 1 and unblocking positions where the barrier arms 18 extend vertically along the upright support means 16. When the arms 18 are in the blocking positions illustrated in FIG. 1, they extend through a distance of approximately 6 feet across each parking space. Each parking space has a width of approximately 8 feet, so that the free end 20 of each barrier arm 18 is located at a distance of approximately 2 feet from the adjoining boundary line 14. As a result, the free ends 20 of a pair of barrier arms 18 which extend toward each other from a pair of successive upright support means 16, when the arms 18 are in their blocking positions as illustrated in FIG. 1, are spaced from each other by a distance of only 4 feet, so that it is not possible for a vehicle to enter through the space between the free ends 20 of a pair of arms 18 which are in their blocking positions. The result is that those boundary lines 14 where there are no upright support means 16 do not require any posts or the like to prevent vehicles from entering into the parking spaces 10 when the arms 18 are in their blocking positions. As a result, when the arms 18 are in their non-blocking positions where they extend substantially vertically along a support means 16, it is easy to drive into a parking space since there is no post which must be avoided by the vehicle, and at the same time the occupants of the vehicle can move into and out of the vehicles with complete comfort since they are not required to squeeze through a narrow space between the vehicle and a post on one side and a support means 16 on the other side.

It is to be noted that with the structure of the invention while each barrier arm 18 has a length of approximately 6 feet, the upright support means 16 extends upwardly from the ground through a distance which is substantially less than 6 feet. For example the upright support means 16 may have a height upwardly from the ground into which it extends on the order of 3 or 4 feet, the upright support means actually having a height above the ground of 3 feet 9 inches in a practical construction which has already been provided with the present invention. Thus, according to the present invention it is possible to make the arms 18 much longer than the extent to which the upright support means 16 extends above the ground, and in addition it is a simple matter to swing the arms 18 between their blocking and non-blocking positions while exerting relatively small force, as will be apparent from the description below.

Figure 3:
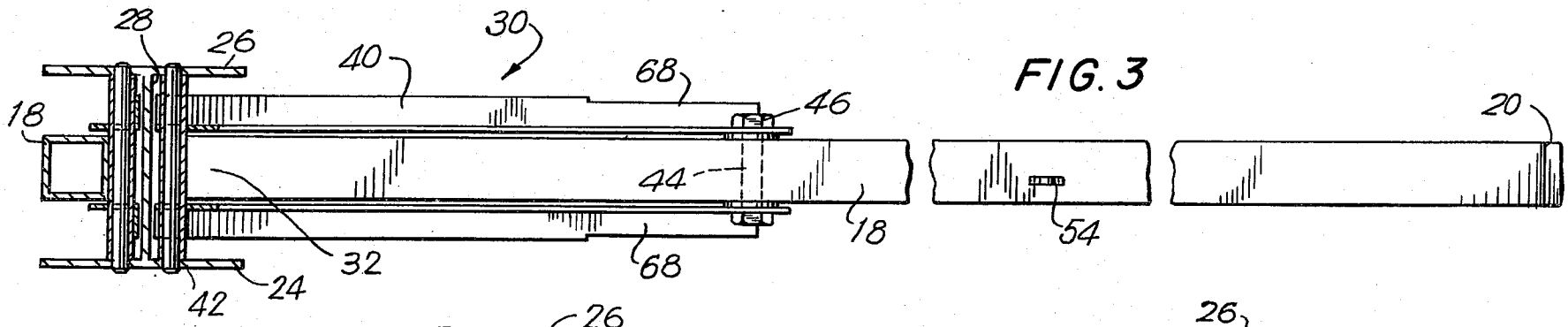
FIG. 3 is a partly sectional plan view of the structure of FIG. 2 taken along line 3—3 of FIG. 2 in the direction of the arrows.
Figures 2, 6, 7, 8:
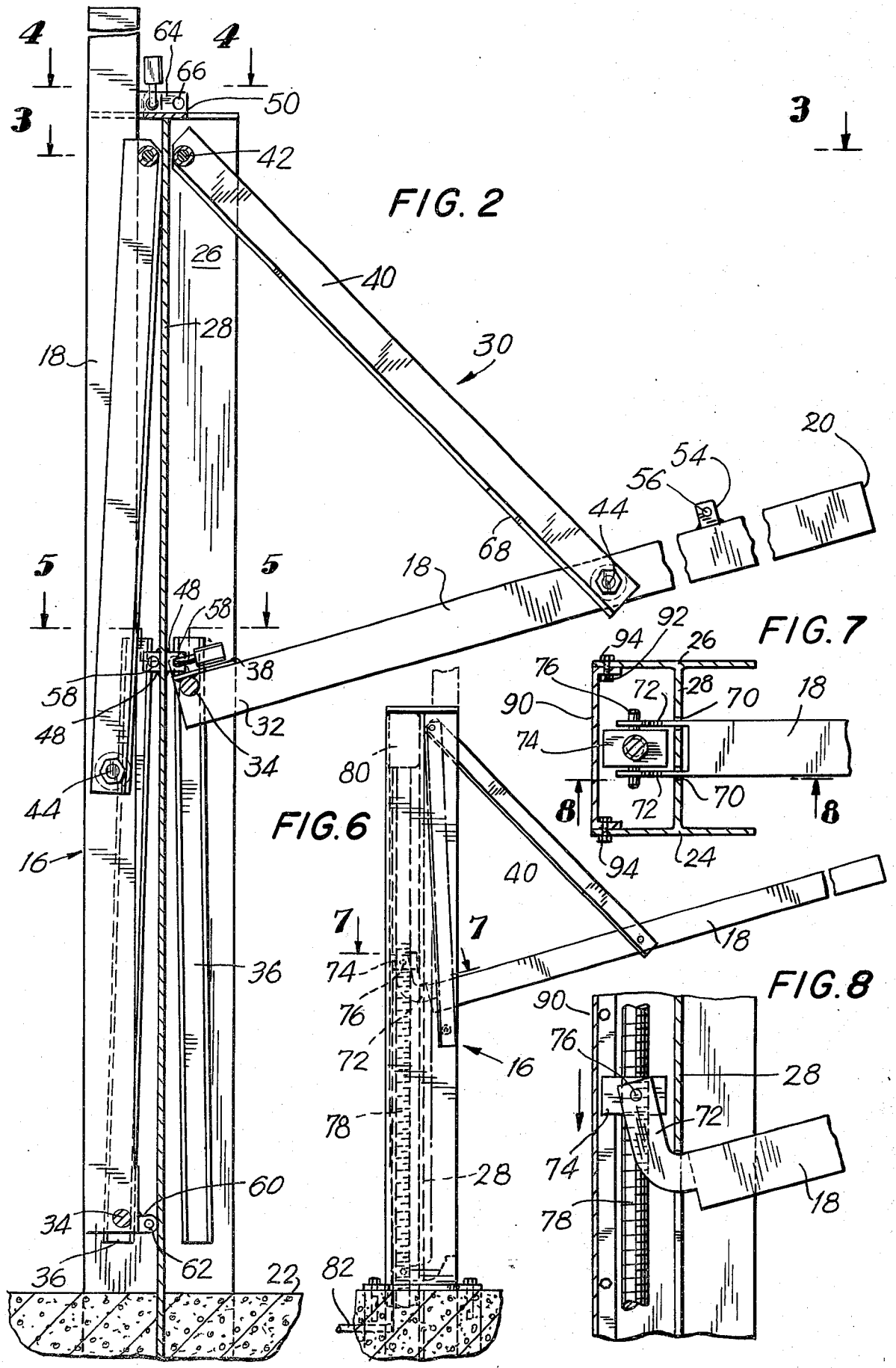
FIG. 2 is a partly sectional elevation illustrating in detail one assembly of the invention.
FIG. 6 is a schematic elevation illustrating a power-driven structure of the invention.
FIG. 7 is a fragmentary sectional plan view taken along line 7—7 of FIG. 6 in the direction of the arrows.
FIG. 8 is a fragmentary elevation of the structure of FIG. 7 taken along line 8—8 of FIG. 7 in the direction of the arrows.

Referring to FIGS. 2 and 3, it will be seen that the upright support means 16 in the illustrated example has the construction of an I-beam which is embedded in the ground 22 on which the vehicle travels, the support means 16 extending vertically up from the ground in a manner illustrated most clearly in FIG. 2. Thus, it will be seen that the upright support means 16 has a front wall 24, a rear wall 26, and a web 28 extending between and being perpendicular to the walls 24 and 26, as illustrated in FIG. 3.

The barrier arm 18 is connected to the upright support means 16 by a connecting means 30 which enables the barrier arms 18 to move between the blocking position shown for the right arm 18 in FIG. 2 and the non-blocking position shown for the left arm 18 in FIG. 2. The connecting means provides for the arm 18, at its inner end region 32, a substantially horizontal axis about which the arm 18 turns when moving between the blocking and non-blocking positions, this horizontal axis being formed by the axis of a rod 34 which extends transversely through and beyond the arm 18 at its inner end region 32. The arm 18 takes the form of a hollow metal bar which may be of rectangular or square cross section.

The connecting means 30 includes, in addition to the rod 34, a guide means formed in part by the free ends of the rod 34, for guiding the arm 18 during its movement between its blocking and non-blocking positions while at the same time guiding the horizontal axis about which the arm turns for movement in a substantially vertical direction. For this purpose, the connecting means includes a pair of channels 36 respectively fixed to inner surfaces of the walls 24 and 26 at each side of the web 28. The channels 36 have a substantially U-shaped cross section, and their hollow interiors are directed toward and aligned with each other on each side of the web 28. The free ends of the rod 34 extend into the pair of aligned channels 36 on each side of the web 28. As is apparent from FIG. 2, the channels 36 extend substantially vertically and are located relatively close to the web 28. These channels 36 may, for example, be welded to the inner surfaces of the walls 24 and 26.

In order to reinforce the rod 34, a reinforcing plate 38 may be welded across the inner end region 32 of the arm 18, and where the reinforcing plate extends laterally beyond the arm 18 it is welded directly to the rod 34 so as to reinforce the latter. The plate 38 can extend almost up to the pair of opposed guide channels 36 at each side of the web 28. As is apparent from FIG. 2, when an arm 18 is in its blocking position, shown at the right of FIG. 2, the rod 34 is adjacent the top end of the channels 36 while when the arm 18 is in its non-blocking position, shown at the left of FIG. 2, the rod 34 is adjacent the bottom ends of the channels 36.

The connecting means also includes for each rod 18 a pair of links 40 which may take the form of a pair of angle irons. A pivot pin 42 extends through and is fixed to upper end regions of the links 40, each pivot pin 42 extending at its free ends into a pair of openings respectively formed in the walls 24 and 26. Thus, in this way the links 40 of the connecting means 30 are pivotally connected to the support means 16 adjacent the upper end thereof.

The links 40 have lower end regions which are pivotally connected to the arm 18 between the opposed ends thereof. Thus, at their lower ends the links 40 define between themselves a space which receives part of the arm 18, and a suitable bolt 44 extends through the lower ends of each pair of links 40 and the arm 18, this bolt being held in position, for example, by a nut 46 and suitable washers, so that in this way the lower ends of the pair of links 40 on each side of the web 28 are pivotally connected to the arm 18 between the opposed ends of the latter.

In addition, the web 28 carries at each of its opposed surfaces a stop means 48 in the form of a suitable block, for example, welded to the web 28. It will be noted that each stop means 40 extends into the space between a pair of channels 36 adjacent the top ends of the latter.

Thus, assuming that an arm 18 is in its blocking position as shown at the right in FIG. 2, then in order to swing the arm 18 to its non-blocking position it is only necessary to raise the outer end region of the arm 18 which is distant from the upright support means 16. The result is that the arm 18 will swing about the axis of the bolt 44 while the rod 34 will move downwardly along the pair of aligned channels 36 toward the bottom end thereof, and the structure will very easily be displaced to the non-blocking position. It will be noted that even though the arm 18 is relatively heavy, since it is supported between its ends by the bolt 44, the part of the arm 18 on one side of the bolt acts at least partly to counterbalance the part of the arm on the other side of the bolt 44, so that in this way it is extremely easy to displace the arm 18 between its blocking and non-blocking positions. Of course, once the center of gravity of the arm 18 moves outwardly beyond the bolt 44, the arm 18 will automatically move to its blocking position where it engages the stop 40. On the other hand, no great effort is required to return the arm 18 to its non-blocking position, since the center of gravity of the arm becomes situated so close to the axis of the bolt 44 that only extremely small moment arms are involved and the structure very readily assumes the position shown at the left of FIG. 2 where the arm 18 remains in its non-blocking position extending vertically along the support means 16.

Figure 4:
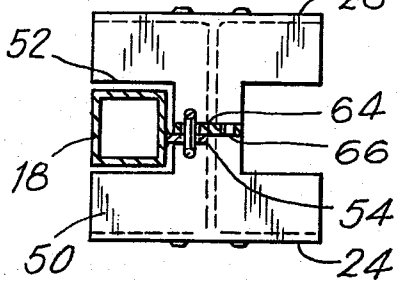
FIG. 4 is a top plan view of the structure of FIGS. 2 and 3 showing the barrier arms in their non-blocking positions.

As is apparent particularly from FIG. 4, the top end of the I-beam which includes the walls 24, 26, and 28, is covered by a plate 50, and this plate 50 is formed with a pair of opposed notches 52 through which the arms 18 extend when they are in their non-blocking positions. As a result of this construction it is apparent that each arm 18 may have a length considerably greater than the height of the support means 16. As was pointed out above, in a particular example of the invention the support means 16 extends through only 3 feet 9 inches above the ground 22 while the arm 18 is approximately 6 feet long so that it extends through more than 2 feet above the plate 50 at the top of the support means 16. Of course this is only by way of example. The arm 18 can be made considerably longer if desired without substantially increasing the height of the support means 16 because the arm 18 swings up to its non-blocking position in which it projects freely upwardly beyond the support means 16.

As was indicated above, as a result of this feature it is possible for the free ends 20 of a pair of arms which project toward each other to be situated close enough to provide between these free ends a distance which is too small to permit a vehicle to pass.

Figure 5:
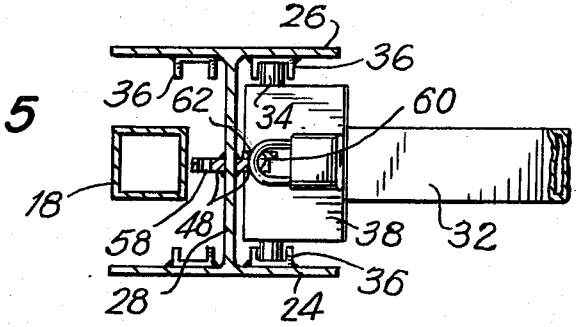
FIG. 5 is a fragmentary partly sectional plan view taken along line 5—5 of FIG. 2 in the direction of the arrows.

In accordance with further features of the invention it is possible to provide releasable lock means for releasably locking the barrier arm 18 in its blocking position shown at the right of FIG. 2 or in its non-blocking position shown at the left of FIG. 2. Thus it will be seen that the barrier arm 18 carries a hasp-like element 54 in the form of a simple plate fixed to and projecting from the upper surface of the arm 18 shown at the right of FIG. 2, this element 54 being formed with an opening 56. The stop means 48 itself is formed with an opening 58 and the reinforcing plate 38 carries a second hasp-like element 60 (FIG. 5) which becomes situated beside the stop means 48 when the arm 18 is in its blocking position, and the element 60 has an opening 62 which becomes aligned with the opening 58 when the arm 18 is in its blocking position. Thus, it is possible to insert a lock through the aligned openings 58 and 62 in order to lock the arm 18 in the position thereof shown in FIG. 2 at the right thereof.

On the other hand, the top wall 50 carries a plate 64 which is welded or otherwise fixed to the top surface of the wall 50, and this plate 64 is formed with an opening 66 which becomes aligned with the opening 56, with the element 54 becoming situated beside the element 64 when the arm 18 is in its non-blocking position. Thus as may be seen from FIG. 4, the element 54 of the arm 18 which is shown in FIG. 4 in its non-blocking position becomes aligned with an opening 66 formed in the element 64, so that suitable locks may be passed through the pairs of aligned openings 56 and 66, in order to releasably lock each barrier arm 18 in its non-blocking position.

As is apparent from FIG. 3, the walls of the angle irons 40 which are perpendicular to the side surfaces of the arm 18 are provided with elongated relatively narror portions 68 for the purpose of clearing the chanels 36.

With the structure described above the arm 18 is capable of being manually displaced between its blocking and non-blocking positions with relatively little force, as described above. However, where the system of the invention is to be used at a location such as the entrance to a parking lot having spaces as shown in FIG. 1, for example, it is preferred to provide a power means for displacing the arm 18 between its blocking and non-blocking positions. Thus as may be seen from FIG. 6, the upright support means 16 shown therein carries only one barrier arm 18 which is suspended from the region of the top end of the support means 16 by a pair of links 40 in the manner described above. However in this case the central web 28 is formed with a pair of vertically extending slots 70 through which a pair of fingers 72 respectively extend. These fingers are fixed to the arm 18 and project therefrom through the slots 70 in the manner shown most clearly in FIG. 7. Thus these fingers may simply form extensions of the side walls of the square tube which is utilized for the arm 18. As may be seen from FIG. 8, the fingers 72 are each of a substantially L-shaped configuration. A nut 74 is situated between these fingers. The nut 74 is fixed with a pair of coaxial rods 76 received in openings of the fingers 72 so that the nut 74 can swivel with respect to the common axis of the rods 76. A rotary screw 78 of considerable length extends through and is threaded with the nut 74, and this screw 78 is driven from any suitable transmission by a motor 80 situated at the side of the web 28 opposite from the arm 18. The motor 80 may be supplied with electrical current as through the leads 82 which are situated underground in the manner shown schematically in FIG. 6. A suitable switch is provided for turning the motor 80 on and off, and this motor 80 may be a reversible motor with a control being provided to cause the motor to rotate in one direction or the other, or the transmission between the motor 80 and the screw 78 may be a reversible transmission, the operator having available a clutch or the like for transmitting the drive from the motor 80 to the screw 78 so as to rotate the latter in one direction or the other.

Depending upon the direction of rotation of the screws 78 the arm 18 will be displaced in one direction or the other between its blocking and non-blocking positions, and thus with a power means of the type shown in FIGS. 6–8 it is possible also to displace the arm 18 between its blocking and non-blocking positions while retaining all of the advantages of the invention as referred to above.

The particular transmission which is shown in FIG. 6 on the left side of the web 28 may be housed in its entirety in a suitable box so that it is completely covered. Such a box may be formed in part by the opposed walls 24 and 26, as well as in part by the intermediate web 28. Space at the side of the web 28 where the motor 80 and the screw 78 are located is closed off, to form a complete box, by a sheet metal body 90 which extends throughout the height of the enclosure defined by the web 28 and the walls 24 and 26 on the left side of the web 28, as viewed in FIG. 7. This sheet metal closure member 90 has inwardly directed flanges 92 fixed to the outer vertically extending edge regions of the walls 24 and 26, at the left thereof, as viewed in FIG. 7, by suitable rows of screws 94 or the like. In this way the entire drive situated to the left of the web 28 in FIG. 7 between the walls 24 and 26 can be boxed in.

Also, any other type of transmission may be provided. For example the motor may be used to drive an endless chain which is carried by a pair of sprockets, with this endless chain having a pin received in a horizontal slot formed in a plate which is supported between the fingers 72 and capable of swivelling thereto in the same way as the nut 74, so that with such an arrangement the motor 80 need not be reversible and at the same time the pin which extends through the slot of the plate pivotally connected to the fingers 72 will displace the arm 18 from its blocking to its non-blocking position while the pin moves downwardly and from its non-blocking to its blocking position while the pin moves upwardly. Thus an arrangement of this latter type may also be used.

It is thus apparent that with the structure of the present invention it is possible to use relatively long barrier arms which in fact are much longer than the upright support means which carry these arms. As a result it is possible for the barrier arms to extend across a space to as great an extent as desired, so as to prevent unauthorized entry into a given space without requiring additional blocking posts or the like to be provided. Furthermore because of the manner in which the barrier arm 18 is hung intermediate its ends from the links 40 the weight of the barrier arm is distributed in such a way that it is possible to displace the barrier arm between its blocking and non-blocking positions while exerting a relatively small force, even though the arm itself is relatively heavy.

It is of course to be understood that certain details described above can be varied without departing from the invention. Thus, for example, the links 40, instead of being situated above the arm 18, can be situated below the arm 18 in the position of the latter shown at the right of FIG. 2, and with such an arrangement of links 40 which extend downwardly from the barrier arm 18 when the latter is in its blocking position it is also possible to provide a suitable structure in accordance with the present invention.

What is claimed is:

1. In a system for at least temporarily preventing the travel of at least one vehicle along at least one path, upright support means situated beside said path, an elongated barrier arm having a blocking position projecting laterally from said upright support means across said path for preventing a vehicle from traveling past said barrier arm along said path when said barrier arm is in said blocking position thereof, and connecting means connecting said barrier arm to said upright support means for swinging movement with respect thereto about a substantially horizontal axis between said blocking position extending across said path and a non-blocking position where said barrier arm extends substantially vertically along said upright support means to be situated with the latter beside said path to permit a vehicle to travel therealong, said connecting means connecting said arm to said support means for swinging movement in an upward direction from said blocking to said non-blocking position and in a downward direction from said non-blocking to said blocking position, and said axis around which said arm swings being situated at the region of a lower end of said arm when the latter is in said non-blocking position thereof, said connecting means having a portion pivotally connected with said arm between opposed ends thereof for turnably supporting said arm between said opposed ends for swinging movement not only with respect to said substantially horizontal axis but also with respect to said portion of said connecting means, whereby one part of said arm on one side of said portion of said connecting means serves at least partially to counterbalance another part of said arm on the other side of said portion of said connecting means, a pair of said barrier arms being connected by a pair of said connecting means to a common upright support means for swinging movement with respect thereto about a pair of said substantially horizontal axes between a pair of blocking positions where said arms respectively project laterally in opposite directions from said common upright support means across a pair of paths which are situated beside each other with said upright support means located therebetween, and said arms when in their non-blocking positions extending substantially vertically and located closely adjacent to each other while extending along said upright support means, said paths respectively leading to a pair of parking spaces which are situated beside each other and access to which is prevented by said arms when the latter are in their blocking positions, the system including a row of said parking spaces separated from each other by boundary lines and said upright support means with said pair of barrier arms connected thereto by said pair of connecting means being situated only at every other boundary line while the remaining boundary lines are completely free and unobstructed, said barrier arms being sufficiently long to extend when in their blocking positions between a pair of successive upright support means through distances sufficiently great to separate the free ends of a pair of barrier arms which extend toward each other from a pair of successive upright support means by a distance which is too small to permit a vehicle to pass through the space between said free ends.

2. In a system as recited in claim 1 and wherein each barrier arm extends through a substantial distance upwardly beyond said upright support means when said barrier arm is in said non-blocking position thereof.

3. In a system as recited in claim 1 and wherein said upright support means includes a pair of walls between which an inner end region of said barrier arm moves substantially vertically during displacement of said arm between said positions thereof, guide means including a pair of elongated guide channels respectively fixed to said walls and having interior guide spaces directed toward and aligned with each other, and a guide rod fixed to said arm at said inner end region thereof and extending laterally across said arm and beyond the latter, said rod having free ends situated in said channels so that the latter together with the free ends of said rod serve to guide said inner end region of said arm during movement of the latter between said positions thereof.

4. The combination of claim 1 and wherein each arm has a portion freely accessible to an individual for manually swinging said arm between said positions thereof.

5. In a system as recited in claim 1 and wherein a power means is operatively connected with said arms for moving the latter between said positions thereof.

6. In a system as recited in claim 1 and wherein said connecting means includes for each arm a pair of links which are parallel to each other and which are each pivotally connected at upper ends to said upright support means while each arm extends between said links at lower ends thereof where said links are pivotally connected to said arm between said end regions thereof.

7. In a system as recited in claim 1 and wherein a stop means is carried by said upright support means in the path of movement of an inner end region of each arm during movement thereof from said non-blocking to said blocking position to engage said inner end region of said arm when the latter reaches said blocking position for preventing further swinging of said arm from said non-blocking toward said blocking position thereof, whereby said stop means determines the blocking position of said arm.

8. In a system as recited in claim 7 and wherein said stop means when engaging said inner end region of said arm to determine the blocking position of the latter situates said inner end region of said arm at an elevation slightly lower than the elevation of the outer end region of said arm so that when the latter is in its blocking position said arm is inclined upwardly with respect to said upright support means while projecting laterally therefrom.

9. In a system as recited in claim 7 and wherein a releasable lock means is carried in part by said stop means and in part by said arm at said inner end region thereof for releasably locking said arm in said blocking position thereof.

10. In a system for at least temporarily preventing the travel of at least a pair of vehicles along a pair of paths which are situated beside each other, said paths respectively leading to a pair of parking spaces which are situated beside each other, and said system including a row of said parking spaces separated from each other by boundary lines, a plurality of upright support means being situated only at every other boundary line while the remaining boundary lines are completely free and unobstructed, a pair of barrier arms respectively situated on opposite sides of each upright support means so that the latter forms a common upright support means situated between each pair of barrier arms, and a pair of connecting means respectively connecting each pair of barrier arms to the common upright support means situated between the same for swinging movement with respect thereto about a pair of substantially horizontal axes between a pair of blocking positions where said pair of arms respectively project laterally in opposite directions from said common upright support means across a pair of said parking spaces which are situated beside each other and said arms being connected by said connecting means to said common upright support means also for swinging movement with respect thereto about said pair of substantially horizontal axes to non-blocking positions, respectively, where said arms extend substantially vertically and are located closely adjacent to each other while extending along said common upright support means, said barrier arms being sufficiently long to extend when in their blocking positions between a pair of successive upright support means through distances sufficiently great to separate the free ends of a pair of barrier arms which extend toward each other from a pair of successive upright support means by a distance which is too small to permit a vehicle to pass through the space between said free ends.

11. The combination of claim 10 and wherein each of said barrier arms when in its blocking position is inclined upwardly from the upright support means to which it is connected by said connecting means.

* * * * *